US006046392A

United States Patent [19]

Saul

[11] Patent Number: 6,046,392

[45] Date of Patent: Apr. 4, 2000

[54] STRINGED MUSICAL INSTRUMENT FRAME HAVING INTERCHANGEABLE SOUNDBOARD AND NECK ASSEMBLY

[76] Inventor: Victor D. Saul, 11 Chelmsley Lane, Marston Green, Birmingham, B37 7BG, United Kingdom

[21] Appl. No.: 09/076,152

[22] Filed: May 12, 1998

Related U.S. Application Data

[60] Provisional application No. 60/047,963, May 28, 1997.

[51] Int. Cl.[7] ..... G10D 3/00

[52] U.S. Cl. ..... 84/291; 84/293; 84/294

[58] Field of Search ..... 84/291, 293, 294, 84/267

[56] References Cited

U.S. PATENT DOCUMENTS

| | | | |
|---|---|---|---|
| D. 209,707 | 12/1967 | Gauvin | D17/20 |
| D. 272,747 | 2/1984 | Nussbaum | D17/14 |
| D. 290,130 | 6/1987 | Steinberger | D17/14 |
| D. 324,693 | 3/1992 | Rose | D17/21 |
| 3,396,621 | 8/1968 | Dycus | 84/293 |
| 3,911,777 | 10/1975 | Rendell | 84/743 |
| 3,915,049 | 10/1975 | Bean | 84/743 |
| 4,132,143 | 1/1979 | Stone | 84/314 R |
| 4,254,683 | 3/1981 | Nulman | 84/1.16 |
| 4,763,555 | 8/1988 | Minakuchi et al. | 84/313 |
| 4,768,415 | 9/1988 | Gressett, Jr. et al. | 84/298 |
| 4,873,908 | 10/1989 | Moore | 84/291 |
| 5,025,696 | 6/1991 | Brown | 84/314 R |
| 5,029,511 | 7/1991 | Rosendahl | 84/743 |
| 5,325,757 | 7/1994 | Ghenea | 84/314 R |
| 5,347,904 | 9/1994 | Lawrence | 84/291 |
| 5,438,158 | 8/1995 | Ribiloff | 84/727 |
| 5,929,362 | 7/1999 | Oteyza | 84/743 |

FOREIGN PATENT DOCUMENTS

| | | |
|---|---|---|
| 2631866 | 1/1977 | Germany . |
| 2831666 | 2/1980 | Germany . |
| 3416581 | 11/1984 | Germany . |
| 2045933 | 11/1980 | United Kingdom . |

*Primary Examiner*—Brian Sircus
*Assistant Examiner*—Kim Lockett
*Attorney, Agent, or Firm*—Richard C. Litman

[57] ABSTRACT

A stringed instrument skeletal frame system is provided with an interchangeable soundboard and an interchangeable neck assembly of such an instrument. The soundboard includes a longitudinal slot. The neck assembly includes a headstock, a fingerboard, a bridge unit, a plurality of strings, and a support frame. The headstock includes a plurality of tuning peg screws. The fingerboard is attached to or may be integrally molded with the neck assembly, and may include a fretted and a fretless portion.

The skeletal frame system includes a fastening device for securing the neck assembly to the soundboard.

8 Claims, 5 Drawing Sheets

STRINGED MUSICAL INSTRUMENT FRAME HAVING INTERCHANGEABLE SOUNDBOARD AND NECK ASSEMBLY

CROSS-REFERENCE TO RELATED APPLICATION

This application claims the benefit of U.S. Provisional Patent Application Ser. No. 60/047,963, filed May 28, 1997.

BACKGROUND OF THE INVENTION

1. Field of the Invention

The present invention relates to stringed musical instruments of the kind having a soundboard and a neck, and deals more particularly with the construction of a stringed instrument skeletal frame system including an interchangeable soundboard and an interchangeable neck assembly.

2. Description of the Prior Art

A stringed musical instrument, such as a guitar, transmits sounds when the musical instrument's strings are plucked, strummed or otherwise made to vibrate. Different styles of music, such as rock and country, may utilize different techniques in playing and can necessitate musical instruments having a variety of soundboard and neck configurations. Furthermore, even within a particular style of music, different performers will have different styles of playing and individual performers may desire a selection of instruments having various soundboard and neck configurations. Generally, stringed musical instruments soundboards and necks are individually formed and glued or otherwise permanently joined together during the production process. As such, anyone desiring the flexibility of different soundboard and neck configurations is generally forced to purchase a separate instrument for each soundboard and neck configuration desired.

One known musical instrument with an interchangeable soundboard and an interchangeable neck is disclosed in U.S. Pat. No. 5,347,904, issued on Sep. 20, 1994 to Barry G. Lawrence. However, Lawrence does not suggest the use of an interchangeable neck comprising a fully installed bridge assembly and strings mounted thereon in accordance with the claimed invention.

Other prior art stringed instruments or constructional techniques are shown or described in U.S. Design Pat. No. 209,707, issued on Dec. 26, 1967 to Charles A. Gauvin; U.S. Design Pat. No. 272,747, issued on Feb. 21, 1984 to Ernest Nussbaum; U.S. Design Pat. No. 290,130, issued on Jun. 2, 1937 to Ned Steinberger; U.S. Design Pat. No. 324,693, issued on Mar. 17, 1992 to Floyd D. Rose; U.S. Pat. No. 3,911,777, issued on Oct. 14, 1975 to Stanley E. Rendell; U.S. Pat. No. 3,915,049, issued on Oct. 28, 1975 to Clifford T. Bean; U.S. Pat. No. 4,132,143, issued on Jan. 2, 1979 to Thomas D. Stone; U.S. Pat. No. 4,763,555, issued on Aug. 16, 1988 to Kiyoshi Minakuchi et al.; U.S. Pat. No. 4,768,415, issued on Sep. 6, 1988 to Charles A. Gresset, Jr., et al.; U.S. Pat. No. 5,025,696, issued on Jun. 25, 1991 to John M. Brown; U.S. Pat. No. 5,029,511, issued on Jul. 9, 1991 to Kevin Rosendahl; U.S. Pat. No. 5,325,757, issued on Jul. 5, 1994 to Serban Ghenea; U.S. Pat. No. 5,438,158, issued on Aug. 1, 1995 to John T. Riboloff; German Patent Number 2,631,866, published on Jan. 20, 1977; and German Patent Number 3,416,581, published on Nov. 8, 1984.

None of the above inventions and patents, taken either singly or in combination, is seen to describe the instant invention as claimed.

SUMMARY OF THE INVENTION

The present invention provides a stringed musical instrument skeletal frame system with an interchangeable soundboard and an interchangeable neck assembly. The interchangeable soundboard includes a longitudinal slot. The interchangeable neck assembly includes a headstock, a fingerboard, a bridge unit, and a frame support to provide releasable communication with the soundboard longitudinal slot. The fingerboard is attached to or may be integrally molded with the neck assembly. In addition, the skeletal frame system includes means for securing the neck assembly to the soundboard. The skeletal framed system can be easily assembled and disassembled by unskilled persons and the system will allow the soundboard and the neck assembly to be easily changed and properly aligned for whatever desired reasons.

Accordingly, it is a principal object of the invention to provide a stringed musical instrument skeletal frame system which includes an interchangeable soundboard and an interchangeable neck assembly.

It is another object of the invention to provide a stringed musical instrument skeletal frame system which can be assembled and disassembled in a matter of minutes by a relatively unskilled person with little effort or training.

It is a further object of the invention to provide improved elements and arrangements thereof in a a stringed musical instrument skeletal frame system for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
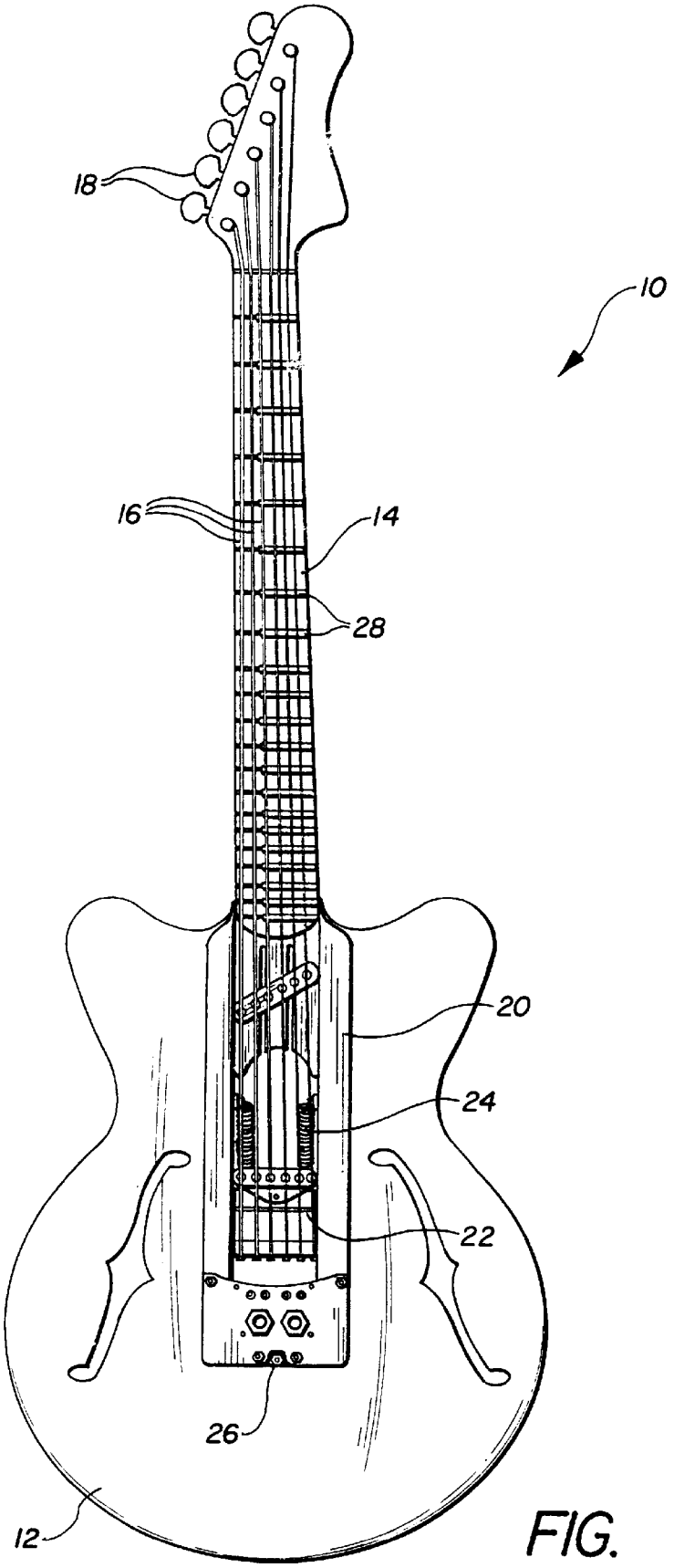
FIG. 1 is a front elevational view of a stringed instrument skeletal frame system according to the invention.

A stringed instrument skeletal frame system 10 according to the present invention is shown in FIGS. 1–7 whose basic components are much the same as are found in most conventional guitars, including a soundboard 12 and a neck assembly. The soundboard 12 has a front side, a rear side, and includes a longitudinal slot 13 on the front side, best seen in FIG. 5, for engagement with the neck assembly. The soundboard 12 may be either a hollow body or a solid body. The neck assembly includes a headstock, a fingerboard 14, a bridge unit 22, and a frame support 20. The headstock is located at the top of the neck assembly and includes a plurality of tuning peg screws 18. Along the length of the neck assembly a fingerboard 14 is affixed or it may be merely an exposed surface of a single component, integral neck assembly structure. There, frets 28 can be seen to be spaced apart and partially embedded in fingerboard 14, the locations of frets 28 being set in a spatial pattern along a major axis thereof corresponding to a desired tonal scale. However, the frets 28 included on this fingerboard do not extend across the entire width of fingerboard 14. As a result, fingerboard 14 has both a fretted and a fretless surface portion, enabling a performer playing the instrument to provide sounds of both a fretted stringed instrument and a fretless stringed instrument concurrently, and to also switch quickly between either if desired. In this embodiment two of strings 16 are provided over a fretless fingerboard surface portion. However, any number of other combinations of fretted and fretless fingerboard surface portions can also be constructed depending on the desires of the performer intending to use the stringed instrument 10 with such a structure. These possibilities provide such a performer a much greater range of sound than is otherwise available on a conventional stringed instrument.

Figure 2:
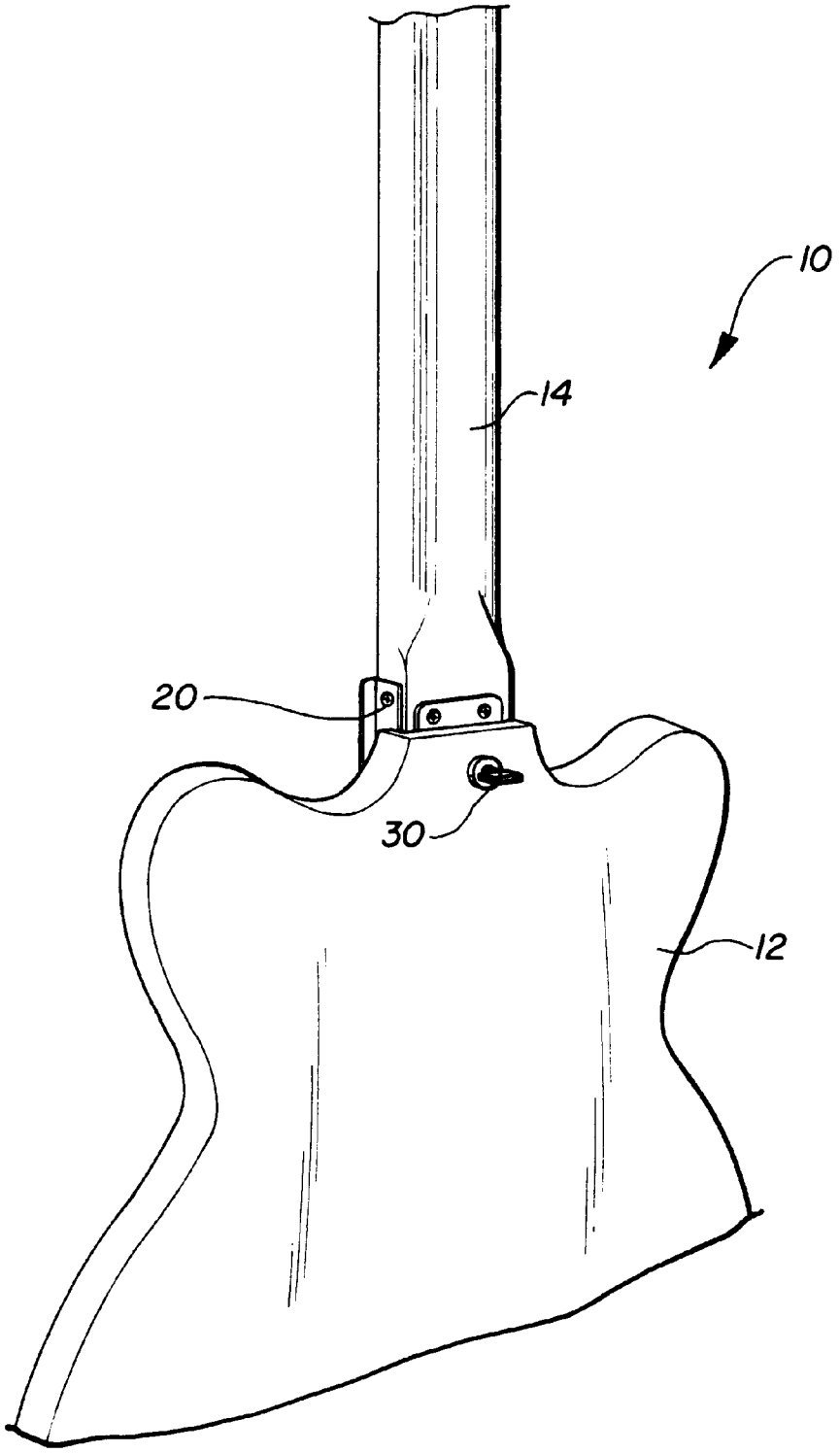
FIG. 2 is a rear elevational view of the stringed instrument skeletal frame system shown in FIG. 1.
Figure 3:
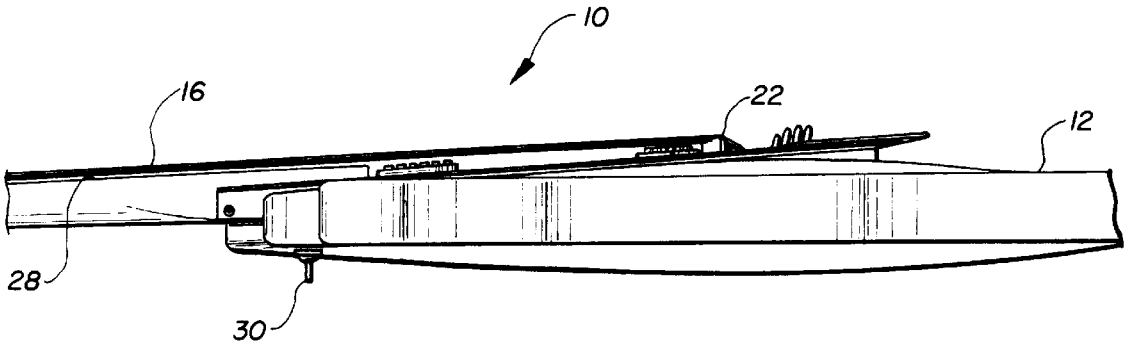
FIG. 3 is a side elevational view of the stringed instrument skeletal frame system shown in FIG. 1.
Figure 4:
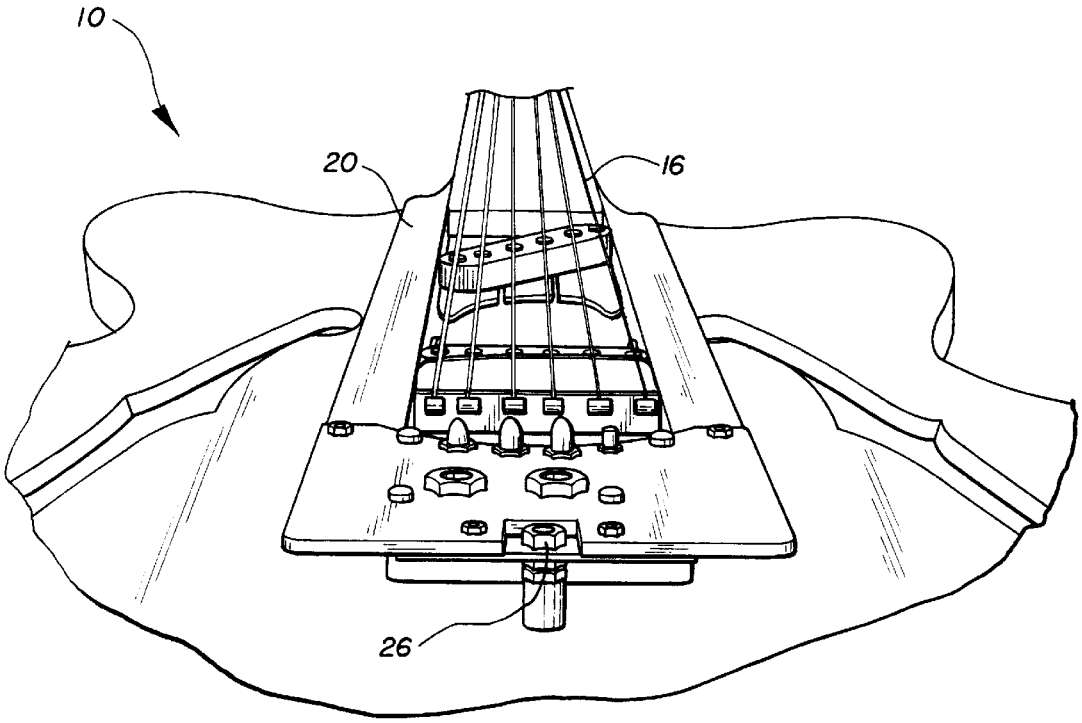
FIG. 4 is a front perspective view of the stringed instrument skeletal frame system shown in FIG. 1.
Figure 5:
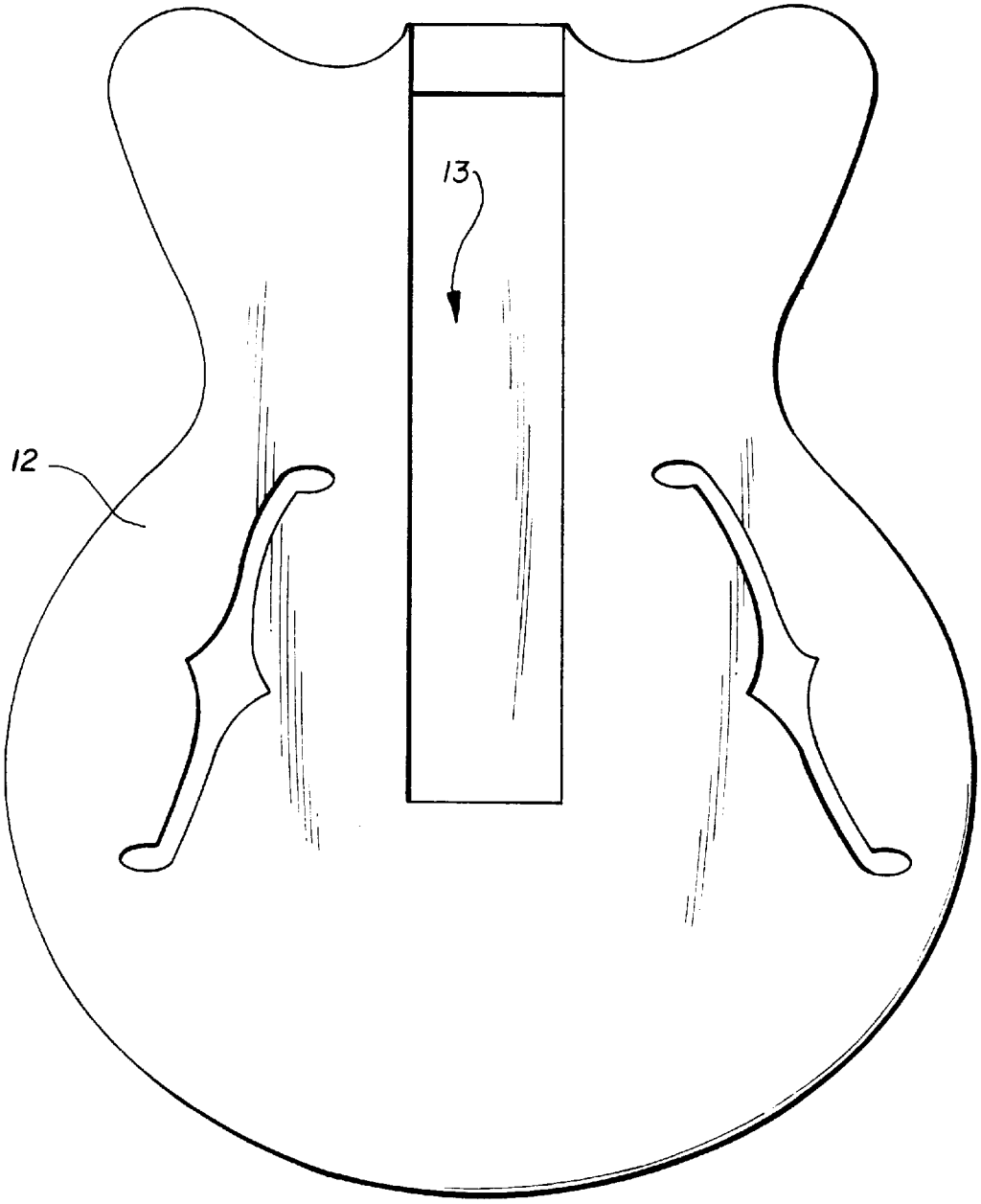
FIG. 5 is a top view of the sound box of the stringed instrument skeletal frame system shown in FIG. 1.
Figure 6:
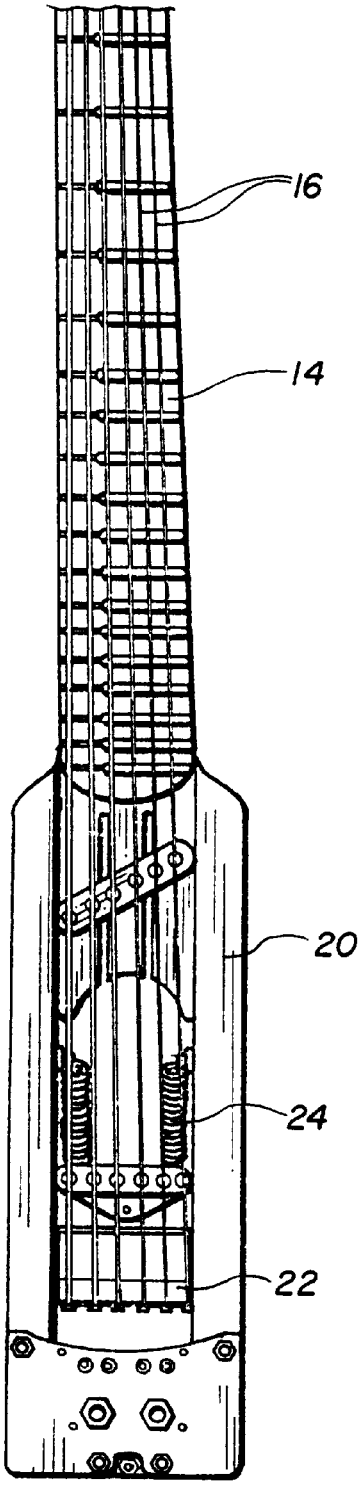
FIG. 6 is a top view of the neck assembly of the stringed instrument skeletal frame system shown in FIG. 1.
Figure 7:
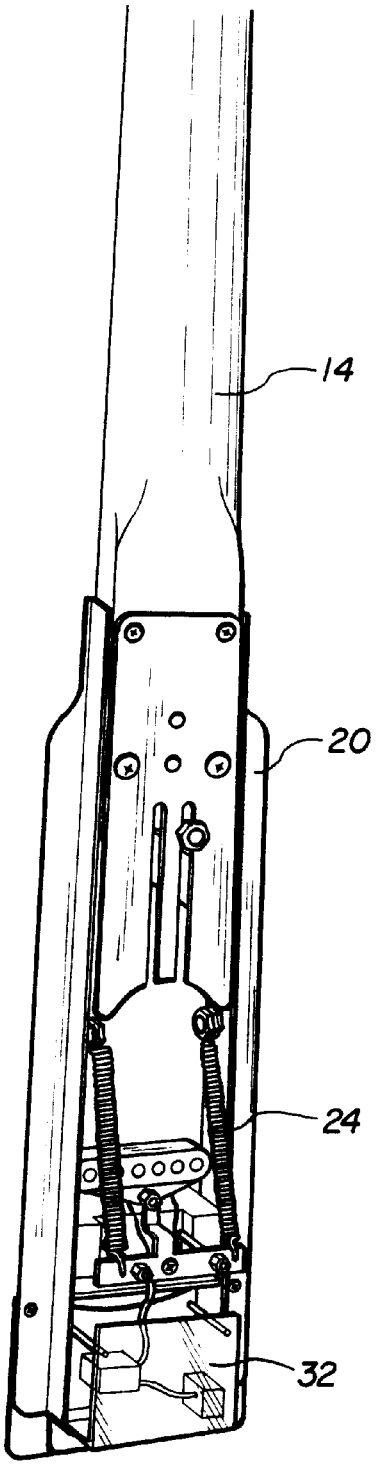
FIG. 7 is a rear view of the neck assembly of the stringed instrument skeletal frame system shown in FIG. 1.

The neck assembly also includes a bridge unit 22 mounted in the lower end. The neck assembly includes strings 16 which are stretched from bridge unit 22 over fretted and fretless portions of fingerboard 14 to tuning peg screws 18 provided on the headstock. Conventional electromagnetic pickups, electric controls, tremolo arrangements, and adjustable truss rods may also be provided. However, this stringed instrument skeletal frame system may also be employed for providing a purely acoustical stringed instrument. As best shown in FIGS. 6 and 7, the neck assembly includes a frame support 20 adapted to be positioned within the longitudinal slot 13 in the soundboard 12. The neck assembly can be quickly and easily removed from the soundboard 12 and replaced with another as desired. The longitudinal slot 13 is preferably sized and shaped to closely and frictionally engage frame support 20 of the neck assembly. The frame support is preferably made from a firm material, such as aluminum, brass, steel, etc. The neck assembly is attached to soundboard 12 by conventional securing means such as fastening screw 30 as seen in FIG. 2. The frame support 20 is generally U-shaped having an L-shaped cross-section, as seen in FIG. 2.

To assemble the stringed instrument skeletal frame system 10 the longitudinal slot 13 in soundboard 12 is positioned against the frame support of the neck assembly. The neck assembly is then urged into the longitudinal slot 13 and fastening screw 30 is then tightened through neck assembly openings located in the rear of the neck assembly. To replace either soundboard 12 or the neck assembly, the steps mentioned above are reversed and in a matter of minutes a new neck assembly or soundboard can be in use.

It is to be understood that the present invention is not limited to the sole embodiment described above, but encompasses any and all embodiments within the scope of the following claims.

I claim:

1. An interchangeable stringed instrument system having multiple tonal characters comprising:

a soundboard having a longitudinal slot;

a neck assembly including a headstock, a fingerboard, a bridge unit, a plurality of strings extending between said headstock and said bridge unit, and a frame support;

said frame support providing a releasable communication with said longitudinal slot of said soundboard;

said frame support having a generally U-shape and wherein each of the leg support is generally L-shaped in cross-section; and means for securing said neck assembly to said soundboard;

wherein said fingerboard includes a fretted portion which extends transversely across said fingerboard beneath at least one of said strings.

2. The stringed instrument skeletal frame system according to claim 1, wherein said soundboard is a solid body.

3. The stringed instrument skeletal frame system according to claim 1, wherein said soundboard is a hollow body.

4. The stringed instrument skeletal frame system according to claim 1, wherein said interchangeable neck assembly includes a tremolo unit.

5. A stringed instrument system having various tonal characteristics due to interchangeability comprising:

a soundboard having a longitudinal slot;

a neck assembly including a headstock, a fingerboard, a bridge unit, a plurality of strings extending between said headstock and said bridge unit, and a frame support;

said frame support providing a releasable communication with said longitudinal slot of said soundboard;

said frame support having a generally U-shape and wherein each of the leg support is generally L-shaped in cross-section; and means for securing said neck assembly to said soundboard;

wherein said fingerboard includes a fretless portion which extends transversely across said fingerboard beneath at least one of said strings.

6. The stringed instrument skeletal frame system according to claim 5, wherein said soundboard is a solid body.

7. The stringed instrument skeletal frame system according to claim 5, wherein said soundboard is a hollow body.

8. The stringed instrument skeletal frame system according to claim 5, wherein said interchangeable neck assembly includes a tremolo unit.

* * * * *